US007093710B2

(12) United States Patent
Shimizu et al.

(10) Patent No.: US 7,093,710 B2
(45) Date of Patent: Aug. 22, 2006

(54) INK-PACKAGE ASSEMBLY, AND METHOD OF PRODUCING THE SAME

(75) Inventors: Yoichiro Shimizu, Kasugai (JP); Bing Wang, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 166 days.

(21) Appl. No.: 10/694,797

(22) Filed: Oct. 29, 2003

(65) Prior Publication Data

US 2004/0134801 A1 Jul. 15, 2004

(30) Foreign Application Priority Data

Oct. 31, 2002 (JP) ..... 2002-317289
Nov. 5, 2002 (JP) ..... 2002-320975

(51) Int. Cl.
*B65D 81/28* (2006.01)

(52) U.S. Cl. ..... 206/213.1; 206/524.8; 53/408

(58) Field of Classification Search ..... 206/205, 206/213.1, 524.8; 347/2, 28, 86, 108; 53/403, 53/405, 408, 432
See application file for complete search history.

(56) References Cited

U.S. PATENT DOCUMENTS 4,148,041 A * 4/1979 Rosenstock ..... 347/28
5,244,087 A * 9/1993 Hikake et al. ..... 206/701
5,980,033 A 11/1999 Nakamura
6,220,702 B1 * 4/2001 Nakamura et al. ..... 347/86
6,450,631 B1 * 9/2002 Hayashi et al. ..... 347/86

FOREIGN PATENT DOCUMENTS

| | | |
|---|---|---|
| JP | A 61-141560 | 6/1986 |
| JP | B2 3-61592 | 9/1991 |
| JP | A 7-17056 | 1/1995 |
| JP | A 7-89086 | 4/1995 |
| JP | A 11-129489 | 5/1999 |
| WO | WO 03/016198 A1 | 2/2003 |

* cited by examiner

*Primary Examiner*—Luan K. Bui
(74) *Attorney, Agent, or Firm*—Oliff & Berridge, PLC

(57) ABSTRACT

An ink-package assembly including an ink package fluid-tightly containing a mass of an ink, and a sealing wrapper fluid-tightly enclosing the ink package, wherein an interior space of the sealing wrapper is charged with an inert gas such as a helium gas, which has a lower degree of solubility in the ink, than the air. The interior space of the sealing wrapper is evacuated to a reduced pressure of −20 kPa and −60 kPa with respect to the atmospheric pressure, as needed. The ink package includes an ink bag and is provided with a spout having a passage, and a cap for closing the passage. Where the sealing wrapper is evacuated, the ink package preferably further includes an ink-bag casing accommodating the ink bag, and a reinforcing structure interposed between the casing and the ink bag, to prevent deformation of the ink bag. Also disclosed is a method of producing the ink-package assembly.

17 Claims, 7 Drawing Sheets

INK-PACKAGE ASSEMBLY, AND METHOD OF PRODUCING THE SAME

The present application is based on Japanese Patent Applications No. 2002-317289 filed Oct. 31, 2002 and No. 2002-320975 filed Nov. 5, 2002, the contents of which are incorporated herein by reference.

BACKGROUND OF THE INVENTION

1. Field of the Invention

The present invention relates in general to an ink-package assembly and a method of producing the same, and more particularly to techniques to minimize deterioration of deaeration (deairing) or degasification (degassing) of the ink-package assembly, and to prevent deformation of an ink package of the assembly due to its evacuation.

2. Discussion of Related Art

JP-A-11-129489 (FIG. 1, in particular) discloses an example of a known ink bag fluid-tightly containing or accommodating a mass of an ink used for an ink-jet recording apparatus. This ink bag has an opening in the form of a sleeve or hollow cylindrical member fixed thereto. An elastic sealing member or plug is fitted in this sleeve member, so that an interior of the ink bag is fluid-tightly isolated from an exterior space of the ink bag. The ink bag is accommodated within a cartridge casing such that the sleeve member is exposed through a side wall of the cartridge casing. In use of the ink bag, the cartridge casing is mounted on the ink-jet recording apparatus, such that the elastic sealing member fitted in the sleeve member is pierced with an ink-outlet needle provided on the ink-jet recording apparatus. The ink-jet recording apparatus has a recording head operable to deliver the ink from the ink bag onto a recording medium, through the ink-outlet needle and a supply conduit or tube connected to the needle.

The ink used for the ink-jet recording apparatus is manufactured by a process including a step of dissolving an ink material in a solvent, and a step of filtering a solution of the ink material. Where the ink as manufactured by this process is contained in the ink bag for use on the ink-jet recording apparatus, various kinds of gasses such as nitrogen, oxygen and carbon dioxide that are dissolved in the ink are introduced with the ink into the recording head, causing bubbles that may prevent the recording head from smoothly delivering droplets of the ink, giving rise to a risk of a poor recording performance of the recording head. To avoid this drawback, it has been practiced to effect a deaerating or degassing treatment of the ink, so as to reduce the amounts of the dissolved gases before the ink bag is filled with the ink. This deaerating treatment involves an operation to stir the ink within a pressure vessel at a reduced pressure (negative pressure).

When the ink bag fluid-tightly filled with the thus deaerated or degassed ink is transported, or stored for a long time before its use, oxygen and other gases in the air may be dissolved in the ink in the ink bag. JP-B2-3-61592 (column 4, lines 4–7, and FIG. 1, in particular) discloses a technique to prevent the dissolution of such gases in the ink. According to this technique, the ink bag filled with the degassed ink is accommodated in a suitable ink-bag casing, and this ink-bag casing is placed in a vacuum chamber the pressure of which is adjusted to a reduced pressure lower than the atmospheric level, and is fluid-tightly enclosed or accommodated within a sealing wrapper or container such as a plastic or rubber bag or a metallic can or box, so that the casing is kept under the reduced pressure in the evacuated sealing wrapper, during transportation or storage of the ink bag. The thus obtained assembly consisting of the ink bag, ink-bag casing and sealing wrapper will be referred to as an "ink-package assembly". The ink bag and the ink-bag casing cooperate to constitute an ink package.

To prevent a poor recording performance of the ink-jet recording apparatus, the ink used for the recording apparatus is required to be kept in a highly deaerated or degassed state, as described above. The ink-package assembly according to the above-indicated technique disclosed in JP-B2-3-61592 permits the ink to be kept in a highly degassed state. Where a plurality of such ink-package assemblies each including a relatively small ink-bag casing are mounted on a carriage of the ink-jet recording apparatus, the ink-bag casing accommodated in the evacuated sealing wrapper more or less collapses due to the reduced pressure within the sealing wrapper. In this case where the walls of the relatively small ink-bag casing of each ink-package assembly has relatively small surface areas, the collapse of the ink-bag casing does not cause a significant problem during use of the ink-package assembly. Where the ink-bag casing has a considerably large volume or is a generally flattened structure, some of the walls of the ink-bag casing have relatively large surface areas, the ink-bag casing tends to be easily deformed under the reduced pressure within the sealing wrapper, causing problems such as difficulty or failure to mount the ink-package assembly on the recording apparatus, and a leakage flow of the ink from the ink-package assembly.

SUMMARY OF THE INVENTION

It is therefore a first object of the present invention to provide an ink-package assembly arranged to minimize deterioration of deaeration of an ink, and optionally to prevent deformation or breakage of an ink package due to evacuation of the interior space of a sealing wrapper. It is a second object of this invention to provide a method of producing the ink-package assembly of the invention.

The first object indicated above may be achieved according to a first aspect of the present invention, which provides an ink-package assembly including an ink package fluid-tightly containing a mass of an ink, and a sealing wrapper fluid-tightly enclosing the ink package, wherein an interior space of the sealing wrapper is charged with an inert gas which has a lower degree of solubility in said ink, than the air.

In the ink-package assembly according to the present invention, the ink package fluid-tightly containing a mass of an ink is fluid-tightly enclosed or accommodated in the sealing wrapper the interior space of which is charged with the inert gas having a lower degree of solubility in the ink than the air, so that the ink within the ink package can be maintained in a highly deaerated or degasified state for a long period of time.

Namely, the amount of the inert gas which permeates through the ink package and which can be dissolved in the ink is significantly smaller than that of the air which would be dissolved in the ink, so that the degree of deterioration of deaeration of the ink in the present ink-package assembly can be effectively reduced. Where the interior space of the sealing wrapper is evacuated to a reduced pressure, as in the prior art ink-package assembly, the required degree of evacuation of the sealing wrapper can be reduced, so that the amount of deformation or collapsing of the ink package due to a difference between the reduced pressure within the sealing wrapper and the atmospheric pressure can be accordingly reduced. Where the interior space in the sealing wrapper is kept at an elevated pressure or a pressure close to the atmospheric pressure, an impact to be given to the sealing wrapper is absorbed by the inert gas contained in the sealing wrapper, so that the ink package is prevented from being damaged In a first preferred form of the ink-package assembly according to the first aspect of the invention, the inert gas is a helium gas.

Where the helium gas is used as the inert gas charging the interior space of the sealing wrapper, the required cost of manufacture of the ink-package assembly is relatively low since the helium gas is a comparatively inexpensive inert gas.

In a second preferred form of the ink-package assembly of the invention, the ink package includes a flexible ink bag having an opening at one end thereof and provided with a spout which is fixed at an outer circumferential surface thereof to an inner surface of the opening, the spout having a passage for communication between an interior space and an exterior space of the ink bag. The flexible ink bag is further provided with a closure member closing the passage. In this form of the ink-package assembly, the flexible ink bag contains the mass of the ink such that the passage is not filled with the ink, and is charged with the inert gas. The spout may be fixed at its outer circumferential surface to the inner surface of the opening. The closure member may be a plug press-fitted in the passage.

In a third preferred form of the ink-package assembly, the ink package includes a flexible ink bag having an opening at one end thereof and provided with a spout which is fixed at an outer circumferential surface thereof to an inner surface of the opening, the spout having a passage for communication between an interior space and an exterior space of the ink bag. The flexible ink bag is further provided with a cap press-fitted in the passage. In this form of the ink-package assembly, the flexible ink bag contains the mass of the ink such that the passage is not filled with the ink, and is evacuated to a reduced pressure lower than the atmospheric pressure.

In the second and third preferred forms of the ink-package assembly of the invention described above, the flexible ink bag contains the mass of the ink such that the passage of the spout is not filled with the ink, namely, the ink bag is not completely filled with the ink, in order to avoid poor tightness between the inner surface of the passage and the outer surface of the cap, which would be caused in the presence of an ink adhering to the inner surface of the passage. In the second preferred form of the ink-package assembly wherein the passage of the spout is also charged with the inert gas, the degree of deterioration of deaeration of the ink is reduced since the amount of the inert gas to be dissolved in the ink in the ink bag is smaller than that of the air which would be dissolved in the ink. In the third preferred form of the ink-package assembly wherein the passage is evacuated to a reduced pressure, the amount of the air to be dissolved in the ink in the ink bag is relatively small, so that the degree of deterioration of deaeration of the ink is reduced.

In a fourth preferred form of the ink-package assembly of the invention, the interior space of the sealing wrapper is evacuated to a reduced pressure lower than the atmospheric pressure such that an inner surface of the sealing wrapper is just in contact with an outer surface of the ink package.

In the ink-package assembly according to the fourth preferred form of the invention, the desired degree of deaeration of the ink can be maintained for a long period of time, while preventing deformation of the ink package due to the reduced pressure within the sealing wrapper, which deformation may prevent adequate mounting of the ink-package assembly on the recording apparatus or cause a leakage flow of the ink from the ink package.

In the above-indicated fourth preferred form of the ink-package assembly, the reduced pressure is preferably selected within a range between about −20 kPa and about −60 kPa with respect to the atmospheric pressure. The reduced pressure within this range is effective to prevent the deformation of the ink package.

In one advantageous arrangement of the ink-package assembly according to the fourth preferred form of the invention, the ink package includes a flexible ink bag fluid-tightly containing the mass of the ink, an ink-bag casing accommodating the flexible ink bag, and a reinforcing structure which is interposed between an inner surface of the ink-bag casing and an outer surface of the ink bag, to prevent deformation of the ink-bag casing due to the reduced pressure within the interior space of the sealing wrapper, for thereby protecting the ink bag against the deformation of the ink-bag casing.

In the above-indicated advantageous arrangement of the ink-package assembly, the reinforcing structure receives a force which is based on the reduced pressure within the sealing wrapper and which acts on the ink-bag casing. Accordingly, the reinforcing member is effective to minimize the amount of deformation of the ink-bag casing, even where the casing has relatively large major surfaces.

In the advantageous arrangement described above, the reinforcing structure positioned in place in the ink-bag casing preferably defines a space which has a shape following a shape of the ink bag and in which the ink bag is accommodated. This arrangement assures a high degree of mechanical strength of the ink-bag casing.

In the same advantageous arrangement, the reinforcing structure preferably includes a first lattice member having a first latticework and a first curved portion for covering one of opposite major surfaces of the ink bag, and a second lattice member having a second latticework and a second curved portion for covering the other of the opposite major surfaces of the ink bag, the first and second lattice members being positioned within the ink-bag casing, such that the ink bag is interposed between the first and second curved portions of the first and second lattice members.

In the ink-package assembly wherein the reinforcing structure includes the first and second lattice members described above, the first and second lattice members are positioned within the ink-bag casing, such that the first and second curved portions cooperate to define therebetween a space in which the ink bag is accommodated. The first and second lattice members receive the force which acts on the ink-bag casing based on the reduced pressure within the sealing wrapper. Since each of the first and second lattice members has the latticework the weight of which is considerably smaller than a solid member, the weight of the reinforcing structure can be significantly reduced, as compared with that of a solid reinforcing structure interposed between the ink bag and the ink-bag casing.

In the ink-package assembly wherein the reinforcing structure has the first and second lattice members as described above, the first and second lattice members preferably further have respective peripheral portions which are located outwardly of the respective first and second curved portions and which cooperate with each other to sandwich a corresponding peripheral portion of the ink bag. In this case, the peripheral portions of the lattice members have a size substantially equal to a size of the peripheral portion of the ink bag.

In the ink-package assembly wherein the first and second lattice members further have the peripheral portions, as described above, the ink bag is accommodated within the space defined by and between the first and second curved portions of the first and second lattice members, while the ink bag is sandwiched at its peripheral portion by and between the peripheral portions of the lattice member. In this arrangement, the first and second curved portions need not be sized so as to cover the peripheral portion of the ink bag as well as the central portion which corresponds to the interior space of the ink bag. Accordingly, the space which is defined by the curved portions and in which the mass of the ink in the ink bag is accommodated can be made relatively small, leading to a relatively reduced size of the ink package.

In one advantageous arrangement of the ink-package assembly wherein the ink package includes the reinforcing structure, the ink bag has an opening at one end thereof and is provided with a spout which is fixed at an outer circumferential surface thereof to an inner surface of the opening, the spout having a passage for communication between an interior space and an exterior space of the ink bag, the ink bag being further provided with a cap press-fitted in the passage. In this case, the spout is fixed to one of opposite ends of the ink-bag casing, and the reinforcing structure positioned in place in the ink-bag casing defines a space in which the ink bag is accommodated. The space is generally tapered in cross section taken in a plane which is generally perpendicular to opposite major surfaces of the ink bag and which is parallel to a direction in which the opposite ends of the ink-bag casing are opposed to each other. The generally tapered space gradually expands in a direction from the other of the above-indicated opposite ends of the ink-bag casing toward the above-indicated one of the opposite ends.

In the arrangement described above, the volume of the ink contained in the portion of the ink bag which is relatively near the spout is considerably larger than that contained in the other portion of the ink bag relatively distant from the spout. This arrangement permits smooth delivery of the ink from the ink bag.

The second object indicated above may be achieved according to a second aspect of the present invention which provides a method of producing an ink-package assembly according to the second preferred form of the first aspect of the invention, comprising the steps of:

an ink filling step of filling the flexible ink bag such that the passage of the spout is not filled with the ink;

an evacuating step of evacuating the passage of the spout and the interior space of the sealing wrapper to a reduced pressure, after the ink filling step, while the ink package is enclosed in the sealing wrapper, and before the cap is press-fitted in the passage; and a gas charging step of charging the passage and the interior space of the sealing wrapper with the inert gas, before the cap is press-fitted in the passage and before the sealing wrapper is fluid-tightly closed to fluid-tightly enclose the ink package.

In the method according to the second aspect of the invention, the flexible ink bag is filled such that the passage of the spout of the ink bag is not filled with the ink. Then, the passage of the spout and the interior space of the sealing wrapper are evacuated to a reduced pressure, while the ink package is enclosed in the sealing wrapper and before the cap is press-fitted in the passage. Then, the passage and the interior of the sealing wrapper are charged with the inert gas before the cap is press-fitted in the passage and before the sealing wrapper is fluid-tightly closed to fluid-tightly enclose the ink package.

Accordingly, the above-described method wherein the passage of the spout of the ink bag is not filled with the ink prevents deterioration of fluid-tightness between the cap and the passage due to an ink adhering to the inner surface of the passage of the spout. While the passage and the interior space of the sealing wrapper are charged with the ink, the amount of the inert gas that can be dissolved in the ink in the ink bag is smaller than that of the air which would be dissolved in the ink. Accordingly, the degree of deterioration of deaeration of the ink can be reduced.

The second object may also be achieved according a third aspect of this invention, which provides a method of producing an ink-package assembly according to the third preferred form of the first aspect of the invention, comprising the steps of:

an ink filling step of filling the flexible ink bag such that the passage of the spout is not filled with the ink;

an evacuating step of evacuating the passage after the ink filling step; and a gas charging step of charging the interior space of the sealing wrapper with the inert gas, after the evacuating step and while the ink package is enclosed in the sealing wrapper with the cap press-fitted in the passage.

In the method according to the third aspect of the invention, the flexible ink bag is filled such that the passage of the spout of the ink bag is not filled with the ink. Then, the passage of the spout is evacuated to a reduced pressure, and the interior space of the sealing wrapper is subsequently charged with the inert gas while the ink package is enclosed in the sealing wrapper with the cap press-fitted in the passage.

Accordingly, the above-described method wherein the passage of the spout of the ink bag is not filled with the ink prevents deterioration of fluid-tightness between the cap and the passage due to an ink adhering to the inner surface of the passage of the spout. Further, the evacuation of the passage of the spout makes it possible to reduce the amount of the air to be dissolved in the ink fluid-tightly contained in the ink bag, so that the degree of deaeration of the ink can be reduced. While the sealing wrapper which fluid-tightly encloses the ink package is charged with the inert gas, the amount of the inert which permeates through the ink package and which can be dissolved in the ink is smaller than that of the air which would be dissolved in the ink. Accordingly, the degree of deterioration of deaeration of the ink can be further reduced.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which.

DETAILED DESCRIPTION OF THE PREFERRED EMBODIMENTS

Figure 1:
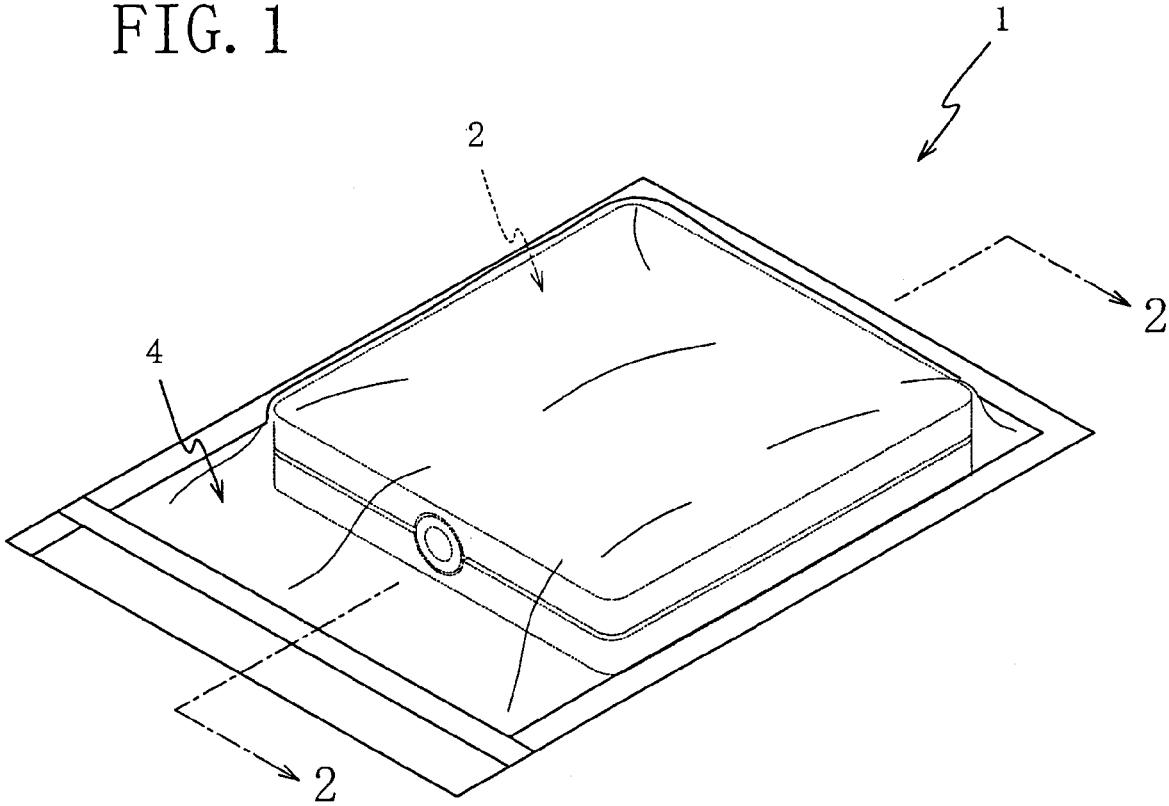
FIG. 1 is a perspective view of an ink-package assembly constructed according to one embodiment of this invention.
Figure 2:
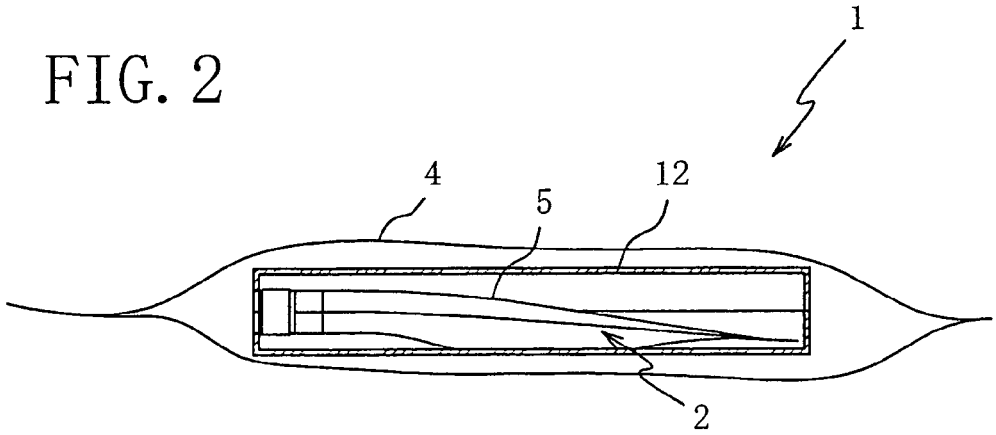
FIG. 2 is an elevational view in cross section take along line 2—2 of FIG. 1.

Referring first to FIGS. 1 and 2, there is shown an ink-package assembly 1, which consists of an ink package 2 and a sealing wrapper 4 in the form of a closed bag fluid-tightly enclosing or covering the ink package 2. The ink package 2 is arranged to fluid-tightly contain a mass of an ink which has been subjected to a deaerating or degassing treatment described above. As described below in detail, the sealing wrapper 4 is charged with an inert gas whose solubility in the ink is lower than that of the air. In this embodiment, the sealing wrapper 4 is charged with a helium gas. If necessary, the sealing wrapper 4 is evacuated to a suitably determined reduced pressure lower than the atmospheric pressure, so that the sealing wrapper 4 is just in contact with the outer surfaces of the ink package 2.

Figure 5:
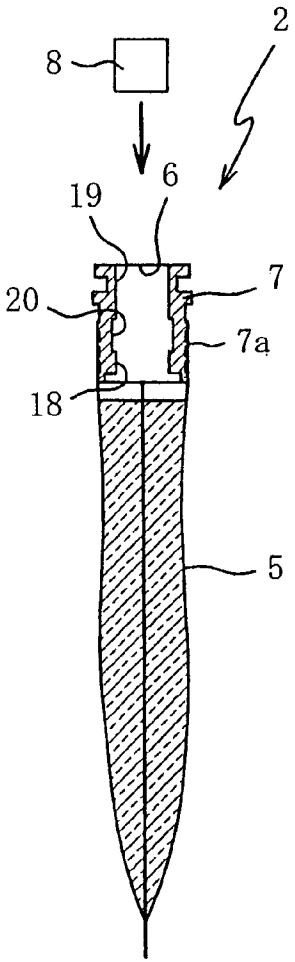
FIG. 5 is a cross sectional view taken along line 5-5 of FIG. 4.
Figure 4:
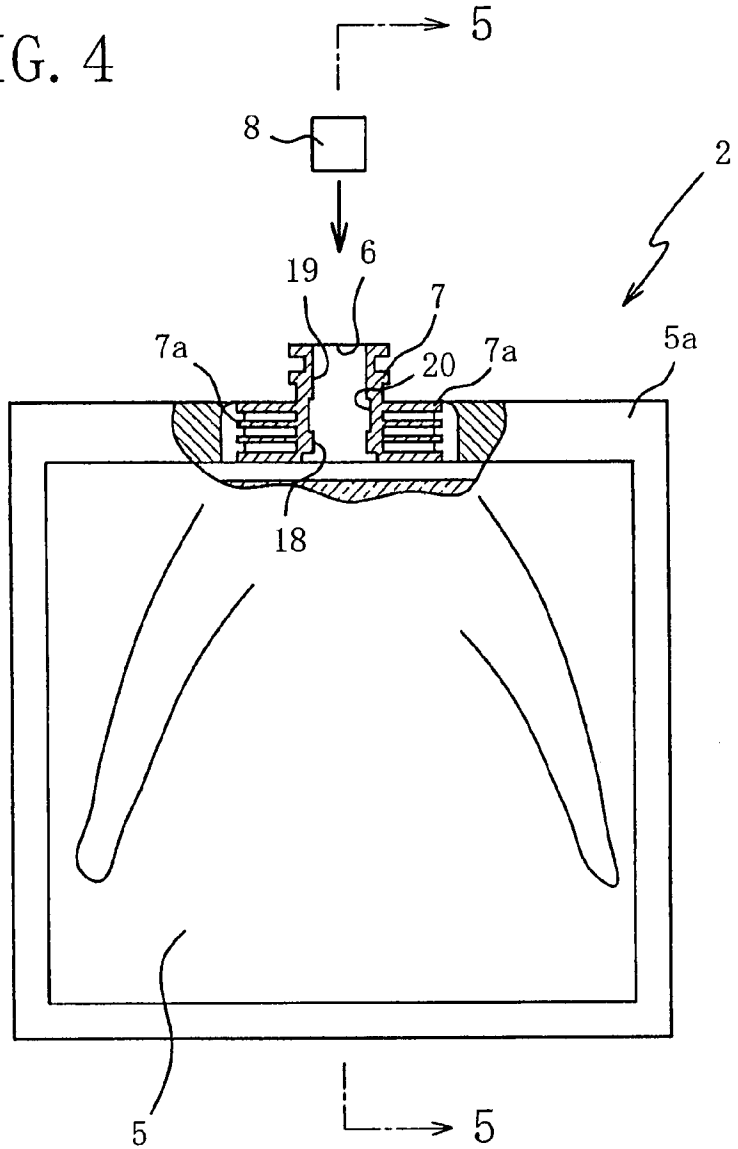
FIG. 4 is a front view partly in cross section of an ink bag of the ink-package assembly.

The ink package 2 includes a flexible ink bag 5 fluid-tightly charged with a suitable volume of a degassed ink, and an ink-bag casing 12 accommodating the ink bag 5. The ink bag 5 is formed from two sheets each in the form of a laminar structure consisting of a plurality of films superposed on each other. The two sheets are superposed on each other and welded together along their peripheries, except a non-welded portion of the periphery of each sheet, such that the two sheets are formed into the ink bag 5 having an opening 5*a* corresponding to the above-indicated non-welded portion, as shown in FIG. 4. The ink bag 5 is provided with a spout 7 welded at its outer circumferential surface to the inner surface of the opening 5*a*, as also shown in FIG. 5. The spout 7 has a passage 6 for communication between an interior space and an exterior space of said ink bag. The spout 7 is arranged such that a closure member in the form of a plug 8 is press-fitted in the spout 7, so as to close the passage 6, that is, to fluid-tightly isolate the interior and exterior spaces of the ink bag 5.

Each of the two sheets used for the ink bag 5 is a laminar structure consisting of an intermediate layer of an aluminum alloy; a first adhesive layer formed on one of opposite surfaces of the aluminum alloy intermediate layer; an outer layer of nylon formed on the first adhesive layer; a second adhesive layer formed on the other surface of the intermediate layer; a layer of polyethylene terephthalate (PET) formed on the second adhesive layer; a third adhesive layer formed on the PET layer; and an inner layer of polypropylene formed on the third adhesive layer. The ink bag 5 formed from the laminar sheets described above has a high degree of durability. In particular, the inner layer of polypropylene enables the ink bag 5 to exhibits a high degree of resistance to corrosion by the ink contained in the ink bag 5, while the aluminum alloy intermediate layer prevents permeation of gases through the ink bag 5, for thereby preventing deterioration of deaeration or gasification of the ink.

The spout 7 welded to the opening 5*a* of the ink bag 5 takes the form of a sleeve member or a hollow cylindrical member formed of a material whose major component is polypropylene having a high degree of ink-corrosion resistance. Namely, the major component of the material of the spout 7 is the same as the material of the inner layer of the ink bag 5, so that a plurality of ribs 7*a* formed integrally on the outer circumferential surface of the spout 7 can be firmly fixed to the opening 5*a*, so as to prevent a flow of gases into the ink bag 5 through the welded portion between the ink bag 5 and the spout 7, for thereby preventing deterioration of deaeration or degasification of the ink within the ink bag 5. The passage 6 formed through the spout 7 has an intermediate space 20 formed between opposite end portions 18, 19. This space 20 has a larger inside diameter than those of the opposite end portions 18, 19, and is arranged to receive the plug 8.

The plug 8 is formed of a butyl rubber or similar material having a high degree of elasticity or resiliency that assures a sufficient degree of fluid tightness of the ink bag 5 even after an ink-outlet needle 17 (which will be described) that has pierced the plug 8 is removed from the plug 8. As indicated above, the plug 8 is press-fitted in the space 20 of the passage 6 of the spout 7. When the plug 8 is pierced with the ink-outlet needle 17, the inner end portion 18 of the passage 6 prevents a displacement of the plug 8 toward the inner open end of the spout 7 (toward the interior space of the bag 5). When the ink-outlet needle 17 is removed from the plug 8, the outer end portion 19 of the passage 6 prevents a displacement of the plug 8 toward the outer open end of the spout 7.

Figure 3:
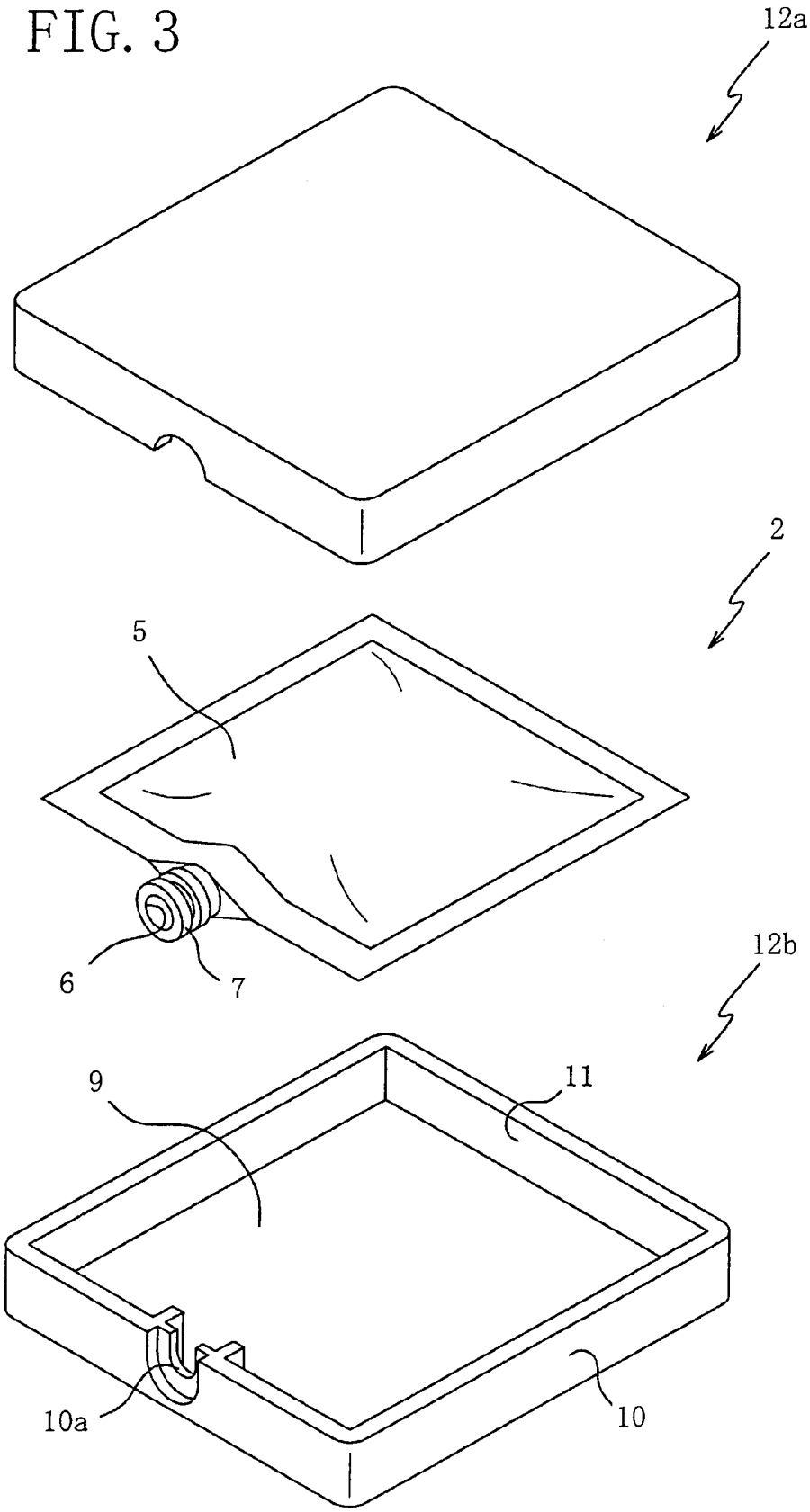
FIG. 3 is an exploded perspective view of an ink package of the ink-package assembly.

As shown in FIG. 3, the ink-bag casing 12 accommodating the thus constructed ink bag 5 includes an upper member 12*a* and a lower member 12*b*, which have substantially the same construction. Each of the upper and lower members 12*a*, 12*b* has a rectangular bottom wall 9, and four side walls 10 extending from respective four side edges of the bottom wall 9. The upper and lower members 12*a*, 12*b* are butted together at the end faces of the four side walls 10, so as to define an interior space 11 in which the ink bag 5 is accommodated such that the opposite major surfaces of the ink bag 5 in a generally flattened shape are opposed to the opposed bottom walls 9.

The bottom wall 9 of each of the upper and lower members 12*a*, 12*b* of the ink-bag casing 12 has a rectangular inner surface which is substantially equal in size with the opposite major surfaces of the ink bag 5. One of the four side walls 10 of each of the upper and lower members 12*a*, 12*b* has a cutout 10*a*, so that the cutouts 10*a* of the two members 12*a*, 12*b* cooperate to define a substantially circular aperture in which the outer end portion of the spout 7 is fixedly fitted such that the plug 8 fitted in the passage 6 is accessible through the aperture formed through the corresponding side walls 10 of the upper and lower members 12*a*, 12*b*. The ink-bag casing 12 accommodating the ink bag 5, that is, the ink package 2 is fluid-tightly enclosed or accommodated in the sealing wrapper 4.

The sealing wrapper 4 is formed from two sheets each in the form of a laminar structure, which does not permit permeation of the air therethrough, like the two sheets used for ink bag 5 described above. The two sheets are superposed on each other and thermally welded together along their peripheries, so as to form the sealing wrapper 4 in the form of a sealing bag. The sealing wrapper 4 prevents permeation of the air therethrough into its interior space, and therefore prevents permeation of the air into the ink bag 5, which would be dissolved in the ink and reduce the degree of deaeration of the ink within the ink bag 5.

The interiors space of the sealing wrapper 4 accommodating the ink package 2 is charged or filled with a helium gas. The interior space of the ink-bag casing 12 is also charged with the helium gas, through a gap between the butted end faces of the side walls 10 of the upper and lower members of the ink-bag casing 12. While the helium gas may permeate through the ink package 2, an amount of the helium gas dissolved in the ink fluid-tightly accommodated in the ink bag 5 is smaller than an amount of the air which would be dissolved in the ink, since the helium gas has a lower degree of solubility in the ink than the air. Accordingly, the degree of deterioration of deaeration of the ink by the helium gas is significantly lower than that by the air. The interior space of the sealing wrapper 4 may be kept at a reduced or negative pressure, at the atmospheric pressure or at an elevated or positive pressure. Where the sealing wrapper 4 is evacuated to a reduced pressure, the reduced pressure is determined such that the sealing wrapper 4 is just in close contact with the outer surfaces of the ink-bag casing 12, under an action of the atmospheric pressure outside the sealing wrapper 4. For instance, the reduced pressure is selected within a range between −20 kPa and −60 kPa with respect to the atmospheric pressure, preferably within a range between −40 kPa and −60 kPa. Where the interior space of the sealing wrapper 4 is kept at an elevated positive pressure, the sealing wrapper 4 is held in an expanded state with the helium gas contained therein. Where the interior space of the sealing wrapper 4 is kept at an elevated pressure or a pressure close to the atmospheric pressure, an impact to be given to the sealing wrapper 4 upon falling of the ink-package assembly 1 or application of an external force to the ink-package assembly 1 during transportation of the assembly 1 is absorbed by the helium gas contained in the sealing wrapper 4, so that the ink-bag casing 12 is prevented from being damaged.

The gas with which the interior space of the sealing wrapper 4 is charged is not limited to the helium gas, but may be a suitable rare gas such as a neon gas, or any other inert gas whose solubility in the ink is lower than that of the air.

Figure 6:
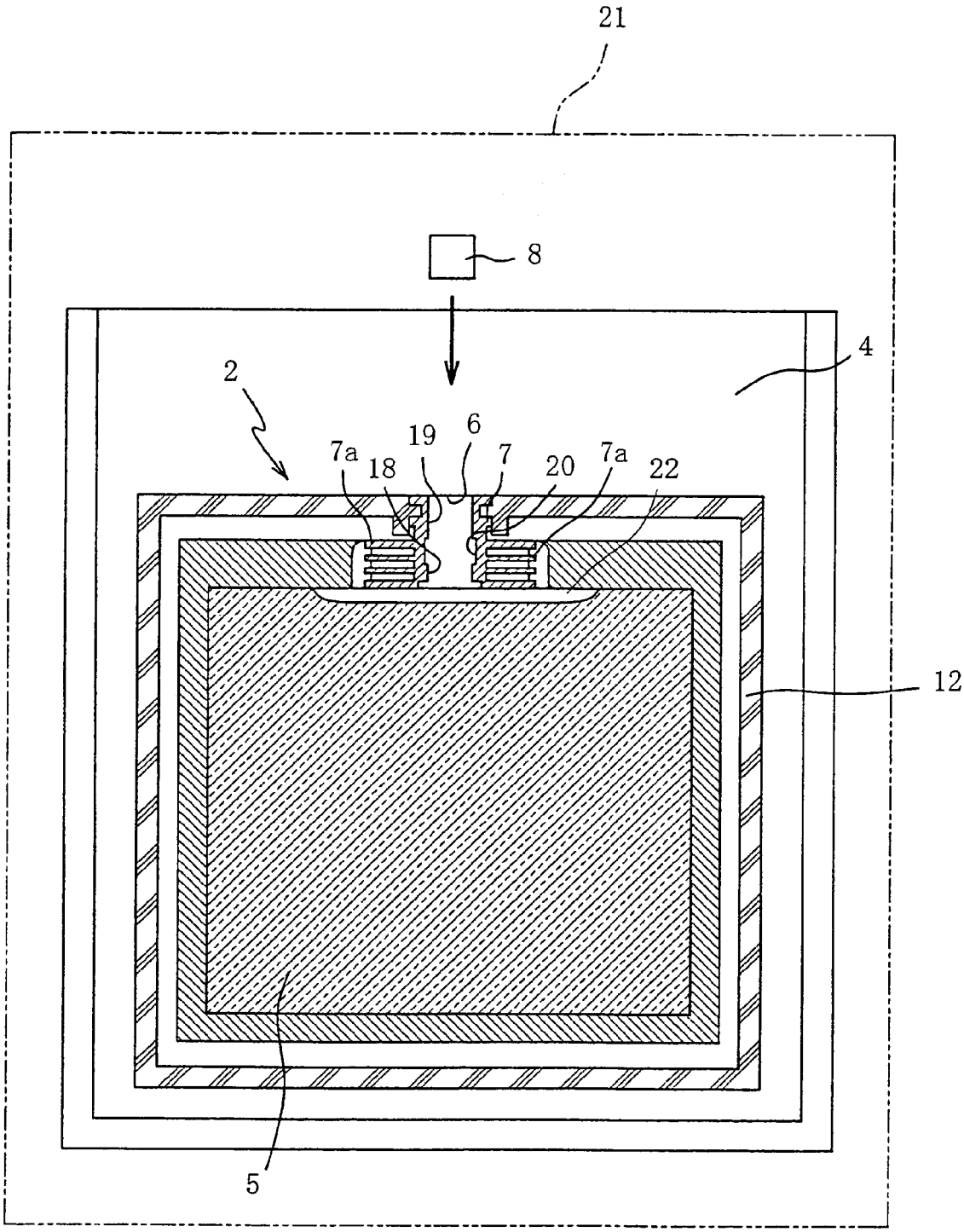
FIG. 6 is a view for explaining a method of producing the ink-package assembly of FIGS. 1 and 2.

Referring next to FIG. 6, there will be described a method of producing the ink-package assembly 1 constructed as described above. Initially, the ink bag 5 accommodated in the ink-bag casing 12 is charged with the ink through the passage 6 formed through the spout 7, while the ink bag 5 is positioned with the passage 6 extending in the vertical direction. In this embodiment, the ink bag 5 is not completely filled with the ink, that is, the ink bag 5 is charged such that the passage 6 of the spout 7 is not filled with the ink, in order to avoid poor tightness between the inner surface of the passage 6 and the outer surface of the plug 8 press-fitted in the passage 6, which would be caused in the presence of an ink adhering to the inner surface of the passage 6. In this manner of charging the ink bag 5 with the ink, the ink bag 5 has a cavity 22 not filled with the ink, at a portion of its interior space adjacent to the lower open end of the spout 7, as shown in FIG. 6.

Where the interior space of the sealing wrapper 4 is evacuated, the ink package 2 accommodating the ink bag 5 charged with the ink as described above is accommodated in the sealing wrapper 4, before the plug 8 is press-fitted in the space 20 of the passage 6 of the spout 7. The ink package 2 enclosed in the sealing wrapper 4 is then placed in a vacuum chamber 21, in an open state of the sealing wrapper 4, so that the passage 6, the cavity 22 within the ink bag 5 and the interior space of the sealing wrapper 4 are kept exposed to a reduced pressure.

The vacuum chamber 21 is filled with a helium gas while the cavity 22 and the interior space of the sealing wrapper 4 are kept exposed to the reduced pressure, so that the passage 6, the cavity 22 and the interior space of the sealing wrapper 4 are filled with the helium gas. The volume of the helium gas introduced into the passage 6, cavity 22 and sealing wrapper 4 determines the pressure within the sealing wrapper 4. Then, the plug 8 is press-fitted in the passage 6 of the spout 7, and the opening of the sealing wrapper 4 is fluid-tightly closed by a thermal welding operation, while the ink package 2 is kept in the vacuum chamber 21. Thus, the ink-package assembly 1 is produced.

In the thus produced ink-package assembly 1 wherein the sealing wrapper 4 is charged with the helium gas, the amount of the helium gas which permeate through the ink bag 5 and spout 7 and which can be dissolved in the ink contained in the ink bag 5 is significantly smaller than that of the air which would be dissolved in the ink, since the helium gas has a lower degree of solubility in the ink than the air. Thus, the helium gas will not considerably deteriorate the deaeration or degasification of the ink. Although the cavity 20 not filled with the ink remains in the ink bag 5, this cavity 20 is filled with the helium gas rather than the air, so that the deterioration of deaeration of the ink is minimized.

In the present method of producing the ink-package assembly 1, the passage 6 and cavity 22 in the ink bag 5 are also filled with the helium gas when the interior space of the sealing wrapper 4 is charged with the helium gas. However, the passage 6 and cavity 22 may be evacuated to a reduced pressure, by first press-fitting the plug 8 in the passage 6 of the spout 7 and then filling the vacuum chamber 21 with the helium gas. In this case, only the interior of the sealing wrapper 4 is charged with the helium gas. In the thus produced ink-package assembly 1, the degree of deterioration of deaeration of the ink due to the helium gas is relatively small, owing to the lower degree of solubility of the helium gas in the ink, even in the event of permeation of the helium gas through the ink bag 5 or spout 7. Since the passage 6 and the cavity 22 remaining in the ink bag 5 are evacuated to a reduced pressure lower than the atmospheric level, the amount of the air to be dissolved in the ink fluid-tightly contained in the ink bag 5 is reduced, permitting further reduction of deterioration of deaeration of the ink.

Figure 7:
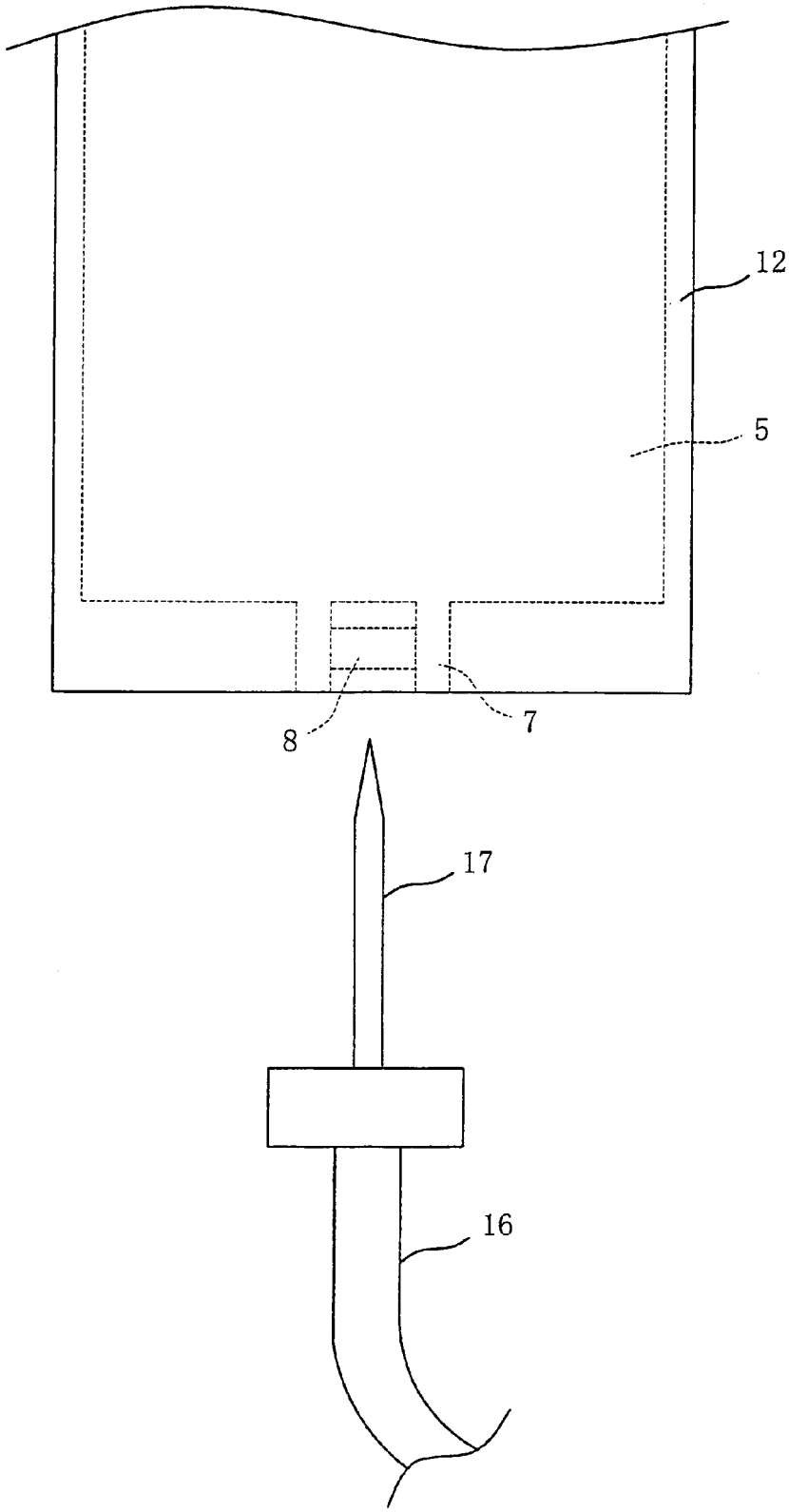
FIG. 7 is an enlarged view showing the ink package and an ink-outlet needle.

When the ink-package assembly 1 constructed as described above is used for an ink-jet recording apparatus, the sealing wrapper 4 is opened, and the ink package 2 is removed from the sealing wrapper 4, as shown in FIG. 7. The ink package 2 is mounted on the ink-jet recording apparatus, with the ink-bag casing 12 being moved along a guide (not shown) provided on the apparatus. Then, the plug 8 is pierced with the ink-outlet needle 17, such that the free end portion of the needle 17 is located within the ink bag 5. The ink-outlet needle 17 is connected to a recording head of the recording apparatus through a supply conduit 16 in the form of a tube, so that the recording head is supplied with the ink.

Figure 8:
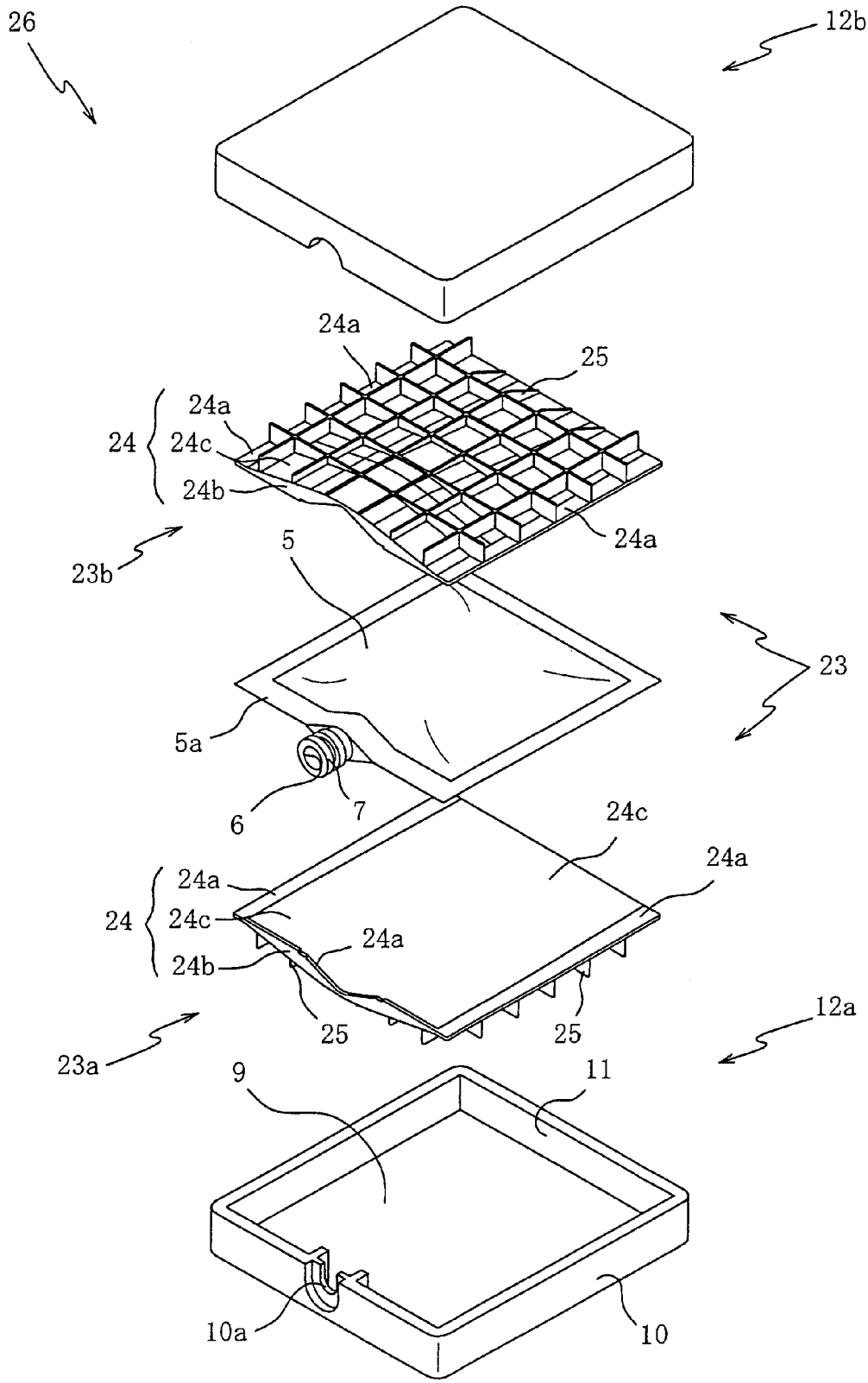
FIG. 8 is an exploded perspective view of an ink-package assembly according to another embodiment of the present invention.
Figure 9:
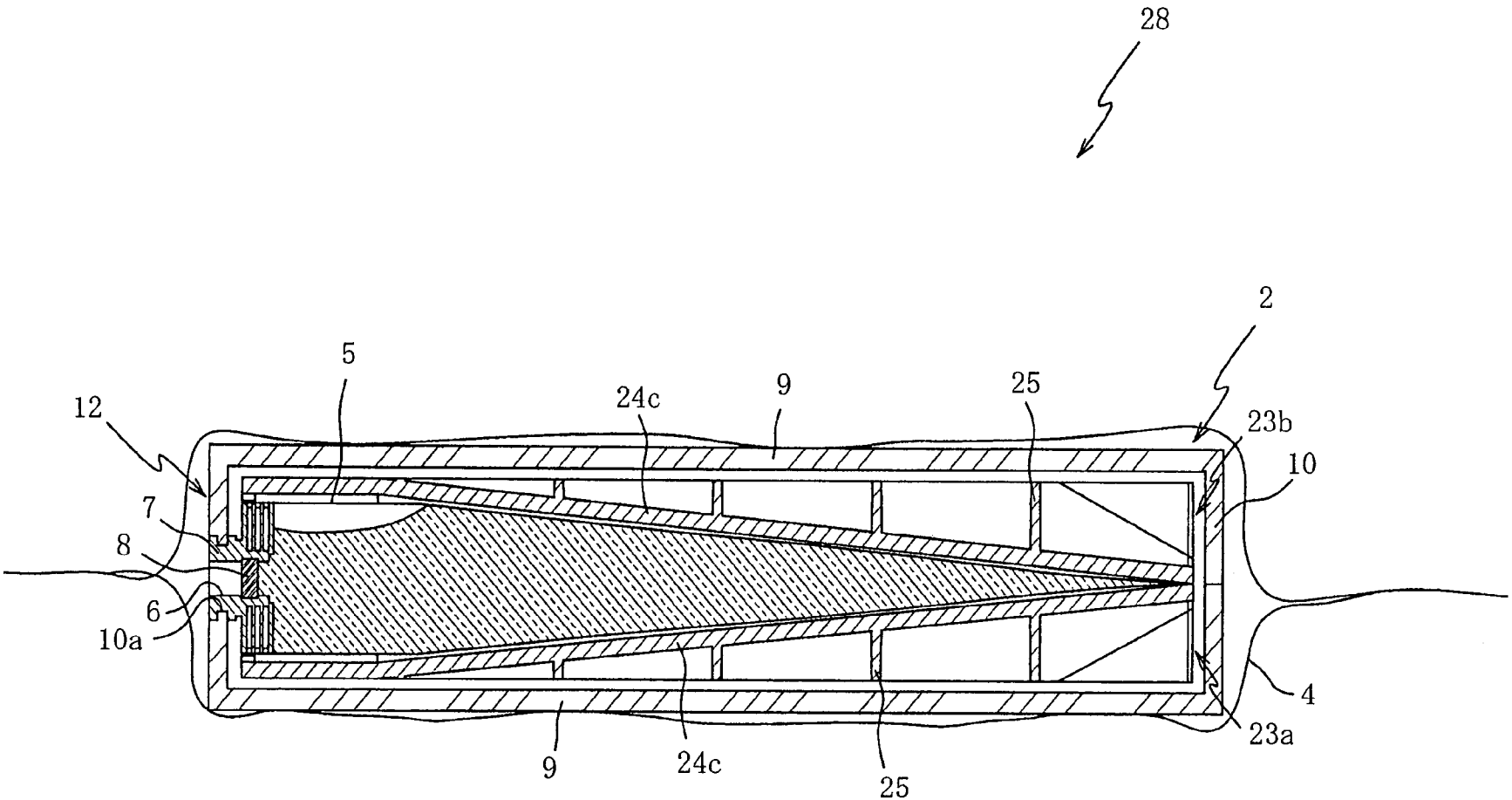
FIG. 9 is a longitudinal cross sectional view of the ink-package assembly of FIG. 8.

Referring next to FIGS. 8 and 9, there will be described an ink-package assembly 28 which includes an ink package 26 and which is constructed according to a second embodiment of this invention. The ink package 26 includes a reinforcing structure 23 interposed between the outer surfaces of the ink bag 5 and the inner surfaces of the ink-bag casing 12. The reinforcing structure 23 is provided to prevent deformation or collapsing of the ink-bag casing 12 which would adversely affect the ink bag 5 accommodated in the ink-bag casing 12. Namely, a reduced pressure within the interior space of the sealing wrapper 4 fluid-tightly enclosing or accommodating the ink package 26 acts on the ink-bag casing 12, so that the ink-bag casing 12 may deform or collapse due to a force based on the reduced pressure.

The reinforcing structure 23 consists of a first lattice member 23*a* having a curved surface for contacting or covering one of the major surfaces of the ink bag 5, and a second lattice member 23*b* having a curved surface for contacting or covering the other major surface of the ink bag 5. In the present embodiment, the first and second lattice members 23*a*, 23*b* are lower and upper lattice members as seen in FIG. 8. Since the first and second lattice members 23*a*, 23*b* are identical in construction with each other, the first lattice member 23*a* will be described. The following description applies to the second lattice member 23*b*.

The first lattice member 23*a* includes a generally curved base plate 24 and a latticework 25, which are respectively located on the side of the above-indicated one major surface of the ink bag 5 and on the side of the inner surface of the bottom wall 9 of the ink-bag casing 12, when the first lattice member 23*a* is positioned in place within the ink-bag casing 12. The latticework 25 is fixed to one of the opposite surfaces of the base plate 24 which is on the side of the bottom wall 9.

The base plate 24 includes a relatively large curved central portion 24*c* that has a curvature following the above-indicated one major surface of the ink bag 5, which surface is convex when the ink bag 5 is filled with the ink. The base plate 24 further includes two relatively narrow parallel flat peripheral portions 24*a*, 24*a* located on the respective opposite sides of the curved central portion 24*c*, and a collar portion 24*b* that extend toward the end of the ink bag 5 on the side of the spout 7, from the corresponding end of the curved central portion 24*c*. The parallel flat peripheral portions 24*a* are located outwardly of the curved central portions 24*c*. As shown in FIG. 9, the curved central portion 24*c* is shaped such that the curved central portions 24*c* of the first and second lattice members 23*a*, 23*b* cooperate to define a space accommodating the ink bag 5 filled with the ink, when the first and second lattice members 23*a*, 23*b* are positioned in the ink-bag casing 12, so as to sandwich the ink bag 5. This space is generally tapered in cross section taken in a plane which is perpendicular to the bottom wall 9 (opposite major surfaces of the ink bag 5) and parallel to the flat peripheral portions 24*a*. The generally tapered space extends in a direction from one of the opposite ends of the casing 12 which is remote from the cutout 10*a*, toward the other end provided with the cutout 10*a*. Namely, the distance between the two curved central portions 24*c* gradually decreases in a direction from the above-indicated end of each central portion 24*c* provided with the collar portion 24*b*, toward the opposite end of the central portion 24*c* remote from the collar portion 24*b*. The size of the base plate 24 as seen in a direction perpendicular to the bottom wall 9 when the first lattice member 23*a* is positioned in the ink-bag casing 12 is almost equal to or slightly larger than the size of the ink bag 5.

The latticework 25 consists of a plurality of first elongate parallel walls parallel to the relatively narrow flat peripheral portions 24*a*, and a plurality of second elongate parallel walls perpendicular to the first parallel walls. These first and second parallel walls extend from one of opposite major surfaces of the base plate 24 which is remote from the ink bag 5, such that the first and second parallel walls are perpendicular to the above-indicated one major surface of the base plate 24. The first and second parallel walls of the lattice work 25 have end faces for contact with the inner surface of the bottom wall 9. That is, these end faces generally define a plane parallel to the inner surface of the bottom wall 9. While the base plate 24 and the latticework 25 may be integrally formed of a resin material as the reinforcing member 23, the latticework 25 may be formed of a paper material (corrugated fiberboard).

The first and second lattice members 23*a*, 23*b* are positioned on the respective opposite sides of the ink bag 5, so as to sandwich the ink bag 5. Since the base plates 24 of the lattice members 23*a*, 23*b* have substantially the same size as the major surfaces of the ink bag 5 filled with the ink, the two flat peripheral portions 24*a* of the lattice members 23*a*, 23*b* cooperate to sandwich the corresponding opposite peripheral portions of the ink bag 5. In this condition, the spout 7 of the ink bag 5 is sandwiched by and between the collar portions 24*b* of the two lattice members 23*a*, 23*b*. The reinforcing member 23 is positioned in place within the ink-bag casing 12 such that the latticeworks 25 of the first and second lattice members 23*a*, 23*b* are located on the side of the bottom walls 9 of the casing 12.

Like the ink package 2 used in the first embodiment, the ink package 26 including the thus constructed reinforcing member 23 is fluid-tightly enclosed or accommodated in the sealing wrapper 4. The interior space of the sealing wrapper 4 is evacuated to a reduce pressure lower than the atmospheric pressure. The reduced pressure is selected within a range between about −20 kPa and −60 kPa with respect to the atmospheric pressure, preferably selected to be about −40 kPa. Further, the sealing wrapper 4 is charged with a helium gas. As a result of the evacuation of the interior space of the sealing wrapper 4 and its charging with the helium gas, the interior space of the ink-bag casing 12 is also evacuated and charged with the helium gas, through a gap between the upper and lower members 12*a*, 12*b*. Where the reduced pressure is selected within the range indicated above, the sealing wrapper 4 is just in contact with the outer surfaces of the casing 12, and an excessive amount of deformation of the casing 12 due to the reduced pressure can be avoided.

In the present embodiment wherein the bottom wall 9 of each of the upper and lower members 12*a*, 12*b* of the ink-bag casing 12 has a larger surface area, the bottom wall 9 may have a risk of some amount of deformation at its central portion due to the reduced pressure in the sealing wrapper 4. In the presence of the reinforcing member 23 within the casing 12, however, a force based on the reduced pressure in the sealing wrapper 4 is received by the reinforcing member 23, so that the deformation of the bottom walls 9 of the upper and lower members 12*a*, 12*b* can be substantially prevented by the reinforcing member 23, even where the bottom walls 9 have a relatively large surface area.

Since the ink bag 5 is sandwiched by the first and second lattice members 23*a*, 23*b* of the reinforcing member 23, the force based on the reduced pressure in the sealing wrapper 4 is received by the reinforcing member 23, and does not act on the ink bag 5. Thus, the reinforcing member 23 protects the ink bag 5 from its breakage due to the reduced pressure and a consequent leakage of the ink from the ink bag 5.

Where the interior of the sealing wrapper 4 is evacuated to a reduced pressure of about −40 kPa, it is difficult to maintain the initial degree of deaeration or degasification of the ink for a long time. In this second embodiment, too, therefore, the residual air in the sealing wrapper 4 is replaced by the helium gas, and the interior space of the ink-bag case 12 is also charged with the helium gas, through the gap between the upper and lower members 12*a*, 12*b*. Even if the helium gas has permeated through the ink bag 5, the amount of the helium gas that can be dissolved in the ink is smaller than that of the air which would be dissolved in the ink, since the helium gas has a lower degree of solubility in the ink. Accordingly, the degree of deterioration of deaeration of the ink can be reduced.

The interior space of the sealing wrapper 4 may be charged with the helium gas and is kept at a pressure not lower than the atmospheric level, to reduce the deterioration of deaeration of the ink. In this case, however, the sealing wrapper 4 is expanded to a relatively large volume, and the volume of the ink-package assembly 28 as a whole is considerably increased, causing a problem in the transportation and storage of the ink-package assembly 28. Where the helium gas is kept at a pressure not lower than the atmospheric level, there is a comparatively high risk of a leakage of the helium gas from the sealing wrapper 4 due to local formation of a pin hole or the like through the sealing wrapper 4 during handling of the ink-package assembly 28. It is generally not easy to detect this leakage of the helium gas at the atmospheric or higher pressure, which results in a flow of the ambient air into the sealing wrapper 4 and consequent deterioration of deaeration of the ink.

In the present embodiment, however, the sealing wrapper 4 is charged with the helium gas kept at a pressure lower than the atmospheric pressure (e.g., about −40 kPa), so that the sealing wrapper 4 is kept compact without expansion, and local formation of a pinhole or the like through the sealing wrapper 4 during handling of the ink-package assembly 28 can be relatively easily detected since a flow of the air into the sealing wrapper 4 through the pinhole causes separation of the wrapper 4 from the outer surfaces of the ink package 26. Thus, the damaged ink-package assembly 28 can be relatively easily detected prior to its use on an ink-jet recording apparatus.

The gas with which the interior space of the sealing wrapper 4 of the present ink-package assembly 28 is charged is not limited to the helium gas, but may be a suitable rare gas such as a neon gas, or any other inert gas whose solubility in the ink is lower than that of the air.

Like the ink-package assembly 1 of the first embodiment, the ink-package assembly 28 of the second embodiment is produced by evacuating the cavity 22 of the ink bag 5 (filled with the ink) and the interior space of the sealing wrapper 4 to a desired reduced pressure (about −40 kPa) within the vacuum chamber 21 filled with the helium gas, and thereby charging the cavity 22 and the interior space of the sealing wrapper 4 with the helium gas. Then, the plug 8 is press-fitted in the passage 6 of the spout 7 of the ink bag 5, and the opening of the sealing wrapper 4 is fluid-tightly closed by thermal welding, while the ink package 26 accommodated within the sealing wrapper 4 is kept within the vacuum chamber 21.

In the ink-package assembly 28 which is constructed and produced as described above, the cavity 22 left within the ink bag 5 and not filled with the ink is filled with the helium gas, and the amount of the helium gas to be dissolved in the ink is smaller than that of the air which would be dissolved in the ink, making it possible to reduce the degree of deterioration of deaeration or degasification of the ink contained in the ink bag 5.

The space which is defined by the reinforcing member 23 positioned within the ink bag 5 and in which the ink bag 5 is accommodated is generally tapered in cross section as shown in FIG. 9, such that the distance between the first and second lattice members 23*a*, 23*b* gradually increases in the direction toward the side walls 10 of the casing 12 which have the cutouts 10*a*. Therefore, the volume of the ink contained in the portion of the ink bag 5 which is relatively near the spout 7 is considerably larger than that contained in the other portion of the ink bag 5 relatively distant from the spout 7. This arrangement permits smooth delivery of the ink from the ink bag 5 to the ink-jet recording apparatus through the ink-outlet needle 17 and the supply conduit 16.

In the present ink-package assembly 28, the reduced pressure within the sealing wrapper 4 is adjusted such that the sealing wrapper 4 is just in contact with the outer surfaces of the ink package 26, so as to prevent deformation of the ink package 26 during transportation of the assembly 28 or storage of the assembly 28 for a long time, which deformation may prevent adequate mounting of the ink-package assembly 28 on the ink-jet recording apparatus. Further, the reinforcing member 23 within the ink-bag casing 12 receives a force based on the reduced pressure in the sealing wrapper 4, and prevents deformation of the casing 12 of the ink package 26 due to the reduced pressure, even where the ink package 26 has relatively large major surfaces. In addition, the use of the helium gas filling the interior space of the sealing wrapper 5 is effective to reduce the degree of deterioration of deaeration of the ink, owing to the lower degree of solubility of the helium gas in the ink than that of the air. Accordingly, the present ink-package assembly 28 assures a good quality of recording by the recording apparatus, without a recording trouble due to air bubbles produced in the ink bag 5.

As in the ink-package assembly 1 of the first embodiment, the interior space of the sealing wrapper 4 may be kept at an elevated or positive pressure or a pressure close to the atmospheric pressure. In this case, an impact applied to the ink-bag casing 12 can be absorbed by the helium gas kept at such a pressure, making it possible to protect the casing 12 against damaging due to the impact.

While the preferred embodiments of the present invention have been described above, for illustrative purpose only, it is to be understood that the invention is not limited to the details of the illustrated embodiments, but may be embodied with various changes, modifications and improvements, which may occur to those skilled in the art, without departing from the spirit and scope of the invention.

While the ink package 2, 26 includes both the ink bag 5 and the ink-bag casing 12, a mass of an ink may be directly contained or accommodated in the casing 12, without the ink bag 5. Alternatively, the ink package does not include the ink-bag casing 12. In this case, the ink bag 5 is directly enclosed in the sealing wrapper 4.

Further, the ink-package assembly 28 may be modified such that the casing 12 directly accommodating the ink is reinforced by a suitable reinforcing member, or such that the ink bag 5 is reinforced by a suitable reinforcing member within the sealing wrapper 4, without the ink-bag casing 12.

What is claimed is:

1. An ink-package assembly including an ink package fluid-tightly containing a mass of an ink, and a sealing wrapper fluid-tightly enclosing said ink package, wherein an interior space of said sealing wrapper is charged with an inert gas which has a lower degree of solubility in said ink, than the air, wherein said ink package includes a flexible ink bag having an opening at one end thereof, and is provided with a spout which is fixed to said opening, said spout having a passage for communication between an interior space and an exterior space of said ink bag, said flexible ink bag being further provided with a closure member closing said passage, and wherein said flexible ink bag contains the mass of the ink such that a portion of said passage between the closure member and the interior space of the ink bag is not filled with the ink, and is charged with said inert gas.

2. The ink-package assembly according to claim 1, wherein said inert gas is a helium gas.

3. The ink-package assembly according to claim 1, wherein said spout is fixed at an outer circumferential surface thereof to an inner surface of said opening.

4. The ink-package assembly according to claim 1, wherein said closure member is a plug press-fitted in said passage.

5. A method of producing an ink-package assembly defined in claim 4, comprising the steps of:

an ink filling step of filling said flexible ink bag such that said passage of said spout is not filled with the ink;

an evacuating step of evacuating said passage of said spout and said interior space of said sealing wrapper to a reduced pressure, after said ink filling step, while said ink package is enclosed in said sealing wrapper, and before said plug is press-fitted in said passage; and a gas charging step of charging said passage and said interior space of said sealing wrapper with said inert gas, before said plug is press-fitted in said passage and before said sealing wrapper is fluid-tightly closed to fluid-tightly enclose said ink package.

6. An ink-package assembly including an ink package fluid-tightly containing a mass of an ink, and a sealing wrapper fluid-tightly enclosing said ink package, wherein an interior space of said sealing wrapper is charged with an inert gas which has a lower degree of solubility in said ink, than the air, and wherein said ink package includes a flexible ink bag having an opening at one end thereof, and is provided with a spout which is fixed to said opening, said spout having a passage for communication between an interior space and an exterior space of said ink bag, said flexible ink bag being further provided with a closure member press-fitted in said passage, and wherein said flexible ink bag containing the mass of the ink such that said passage is not filled with the ink, and is evacuated to a reduced pressure lower than the atmospheric pressure.

7. The ink-package assembly according to claim 6, wherein said spout is fixed at an outer circumferential surface thereof to an inner surface of said opening.

8. The ink-package assembly according to claim 6, wherein said closure member is a plug press-fitted in said passage.

9. A method of producing an ink-package assembly defined in claim 8, comprising the steps of:

an ink filling step of filling said flexible ink bag such that said passage of said spout is not filled with the ink;

an evacuating step of evacuating said passage after said ink filling step; and a gas charging step of charging said interior space of said sealing wrapper with said inert gas, after said evacuating step and while said ink package is enclosed in said sealing wrapper with said plug press-fitted in said passage.

10. An ink-package assembly including an ink package fluid-tightly containing a mass of an ink, and a sealing wrapper fluid-tightly enclosing said ink package, wherein an interior space of said sealing wrapper is charged with an inert gas which has a lower degree of solubility in said ink, than the air, and wherein said interior space of said sealing wrapper is evacuated to a reduced pressure lower than the atmospheric pressure such that an inner surface of said sealing wrapper is just in contact with an outer surface of said ink package.

11. The ink-package assembly according to claim 10, wherein said reduced pressure is selected within a range between about −20 kPa and about −60 kPa with respect to the atmospheric pressure.

12. The ink-package assembly according to claim 10, wherein said ink package includes a flexible ink bag fluid-tightly containing said mass of the ink, an ink-bag casing accommodating said flexible ink bag.

13. The ink-package assembly according to claim 12, wherein said ink bag has an opening at one end thereof and is provided with a spout which is fixed at an outer circumferential surface thereof to an inner surface of said opening, said spout having a passage for communication between an interior space and an exterior space of said ink bag, said ink bag being further provided with a plug press-fitted in said passage, and wherein said spout is fixed to one of opposite ends of said ink-bag casing, and said reinforcing structure positioned in place in said ink-bag casing defines a space in which said ink bag is accommodated, said space being generally tapered in cross section taken in a plane which is generally perpendicular to opposite major surfaces of said ink bag and which is parallel to a direction in which said opposite ends of said ink-bag casing are opposed to each other, said generally tapered space gradually expanding in a direction from the other of said opposite ends of said ink-bag casing toward said one of said opposite ends.

14. The ink-package assembly according to claim 12, wherein said ink package further comprises a reinforcing structure which is interposed between an inner surface of said ink-bag casing and an outer surface of said ink bag, to prevent deformation of said ink-bag casing due to said reduced pressure within said interior space of said sealing wrapper, for thereby protecting said ink bag against the deformation of said ink-bag casing.

15. The ink-package assembly according to claim 14, wherein said reinforcing structure positioned in place in said ink-bag casing defines a space which has a shape following a shape of said ink bag and in which said ink bag is accommodated.

16. The ink-package assembly according to claim 14, wherein said reinforcing structure includes a first lattice member having a first latticework and a first curved portion for covering one of opposite major surfaces of said ink bag, and a second lattice member having a second latticework and a second curved portion for covering the other of said opposite major surfaces of the ink bag, said first and second lattice members being positioned within said ink-bag casing, such that said ink bag is interposed between said first and second curved portions of said first and second lattice members.

17. The ink-package assembly according to claim 16, wherein said first lattice member further has a first peripheral portion located outwardly of said first curved portion, and said second lattice member further has a second peripheral portion located outwardly of said second curved portion, said first and second peripheral portions cooperating to sandwich a corresponding peripheral portion of said ink bag, and having a size substantially equal to a size of said peripheral portion of said ink bag.

* * * * *